United States Patent [19]

Reil

[11] Patent Number: 4,527,563

[45] Date of Patent: Jul. 9, 1985

[54] STERILE EARLOBE PIERCING ASSEMBLY

[76] Inventor: Vladimir Reil, 740 W. 16th St., San Pedro, Calif. 90731

[21] Appl. No.: 457,447

[22] Filed: Jan. 12, 1983

[51] Int. Cl.[3] ..... A61B 17/34

[52] U.S. Cl. ..... 128/329 R; 128/330

[58] Field of Search ..... 128/329 R, 330

[56] References Cited

U.S. PATENT DOCUMENTS

| | | | |
|---|---|---|---|
| 3,500,829 | 3/1970 | Abramowitz | 128/329 R |
| 4,020,848 | 5/1977 | DiCicco | 128/330 |
| 4,030,507 | 6/1977 | Mann | 128/330 |
| 4,068,668 | 1/1978 | Moore et al. | 128/330 |
| 4,079,740 | 3/1978 | Phalon | 128/330 |
| 4,146,032 | 3/1979 | Rubenstein et al. | 128/330 |
| 4,286,600 | 9/1981 | Judickas | 128/330 |

*Primary Examiner*—C. Fred Rosenbaum
*Assistant Examiner*—C. W. Shedd
*Attorney, Agent, or Firm*—Cislo, O'Reilly & Thomas

[57] ABSTRACT

An ear stud implacement system that embodies a gun-type stud setting member wherein sterility in high hygiene conditions are maintained in the piercing of ears and the setting of studs or posts thereinto in secure relationship with the back clasp or nut of the stud or post. The improved system utilizes a stud gun having the components that come in contact with the earlobe and the like, that are disposable such that germs or even disease are not transmitted through the stud gun components from one person's ears to another's. The system allows for implacement of sterile components and the placement of stud and back in the ear under sterile conditions not requiring touching of, for example, the stud and clasp with human hands or the touching of the replaceable components of the stud gun with human hands thereby decreasing the risk involved, of one getting their ears pierced, of contracting hepatitis due to the fact that another's blood may be on the stud gun components to, quite possibly, infect another during the ear piercing operation.

7 Claims, 10 Drawing Figures

STERILE EARLOBE PIERCING ASSEMBLY

BACKGROUND OF THE INVENTION

Stud guns of the type used for piercing ears and the implacement of studs or posts in the ear during the same piercing action have been in ubiquitous use for some time. In the stud gun piercing of ears, the stud and clasp or back of the stud are typically shot through the earlobe in singular fashion in an almost painless fashion under rapid circumstances.

In the ear piercing business many women decide, impulsively, to have their ears pierced and in jewelry and department stores, a backup of purchasers of the service requires that the service be performed as quickly as possible without testing the patience of the prospective purchaser. Thus, under such conditions, the operator of the stud gun in piercing the ears does not always ensure that the stud gun components coming in contact with the ear during the preceding ear piercing operation has been cleansed of even microscopic quantities of blood for the subsequent ear piercing operation.

Consequently, it has not been uncommon for women who have had their ears pierced to contract hepatitis or other blood related diseases by reason of the dearth of hygenic conditions under which ear piercing has been traditionally carried out. The situation has become serious enough to warrant several governmental bodies passing laws to protect customers, who wish to have their ears pierced, from contracting serious diseases such as hepatitis.

The herein disclosed system is one which creates the highest hygenic, sterile conditions possible in ear piercing short of having ears pierced by a surgeon under operating room conditions. That is, the typical components of a stud gun used in ear piercing and setting of the stud during the ear piercing operation are made in a manner that they are individually disposable and are positioned in the stud gun under sterile conditions such that it is next to impossible to have the transmission of blood diseases, or the like, through ear piercing. The system also allows for the sterile placement of the stud and clasp with the stud gun mechanism so that human hands never contact the salient components of the stud gun mechanism or the stud and clasp itself. Hence, almost sterile conditions are maintained during the ear piercing operation.

In conjunction with the sterile stud implacement system of the invention is the utilization of studs and clasps that are packaged in sterile blister packs which are opened at the time of the ear piercing. Additionally, the disposable components that are used in the stud gun and are only used with one customer, are also individually blister packaged under sterile conditions such that almost absolute sterility is ensured for each customer wishing to have their ears pierced.

Thus, it is no longer necessary to have several stud guns undergoing various phases of sterilization or to have conditions that might foster the transmission of serious diseases during ear piercing and stud implacement procedures.

OBJECTS AND SUMMARY OF THE INVENTION

It is an object of the invention to provide a sterile stud implacement system.

It is another important object of the invention to provide a sterile stud implacement system wherein a stud gun is used having disposable components and wherein those disposable components are assembled into the stud gun under sterile conditions.

It is another, even further, more important object of the invention to provide an ear piercing system wherein the stud and clasps are maintained under hygenic conditions and wherein the stud gun has disposable components which components are replaced for each piercing operation and wherein human hands never touch the disposable components.

It is another, even further, more specific, important object of the invention to provide a stud gun having disposable components such that almost sterile conditions are assured for each ear piercing operation.

It is another, even further, specific, more important object of the invention to provide an ear piercing stud gun wherein certain components of the gun are assembled thereinto under sterile conditions and are later discarded after the ear piercing operation.

It is another, even further, more specific object of the invention to provide an ear piercing system which is highly hygenic wherein the stud and clasp are maintained in sterile condition until point of use and wherein a stud gun has disposable components which are maintained in sterile conditions until ready to use and wherein such components are easily assembled into the stud gun without the need to touch same with the human hand.

It is another, further important object of the invention to provide an almost sterile ear piercing procedure and system wherein disposable components of a stud gun are utilized for each customer wishing to have her ears pierced and wherein those components are maintained under sterile conditions until ready to use and need not be touched by the hands of the person doing the ear piercing.

Generally, in an exemplary embodiment, the invention is directed to a sterile stud implacement system comprising the combination of a pistol-like member, having a handle portion and a barrel portion, said barrel portion carrying a plunger member for axial movement from a first, cocked position to a second, released position and being operatively connected to a trigger member wherein the trigger member has a clasp carrying portion and the trigger member is positionable in a first, clasp carrying position and a second, clasp setting position. The triggering of the trigger member causes said plunger member and said clasp carrying portion to be forcibly driven towards each other to almost engage at an intermediate alignment member operatively associated with said barrel portion. The end surface of the plunger member is provided with a recess to receive a separable and disposable stud driver. The clasp carrying portion, intermediate alignment member and the stud driver are releasably and disposably retained in operative relationship for singular, sterile stud and clasp implacement in earlobes and the like.

These and further objects of the invention will become more apparent from the hereinafter following commentary taken in conjunction with the figures and drawings.

DESCRIPTION OF THE BEST EMBODIMENTS CONTEMPLATED

Figure 1:
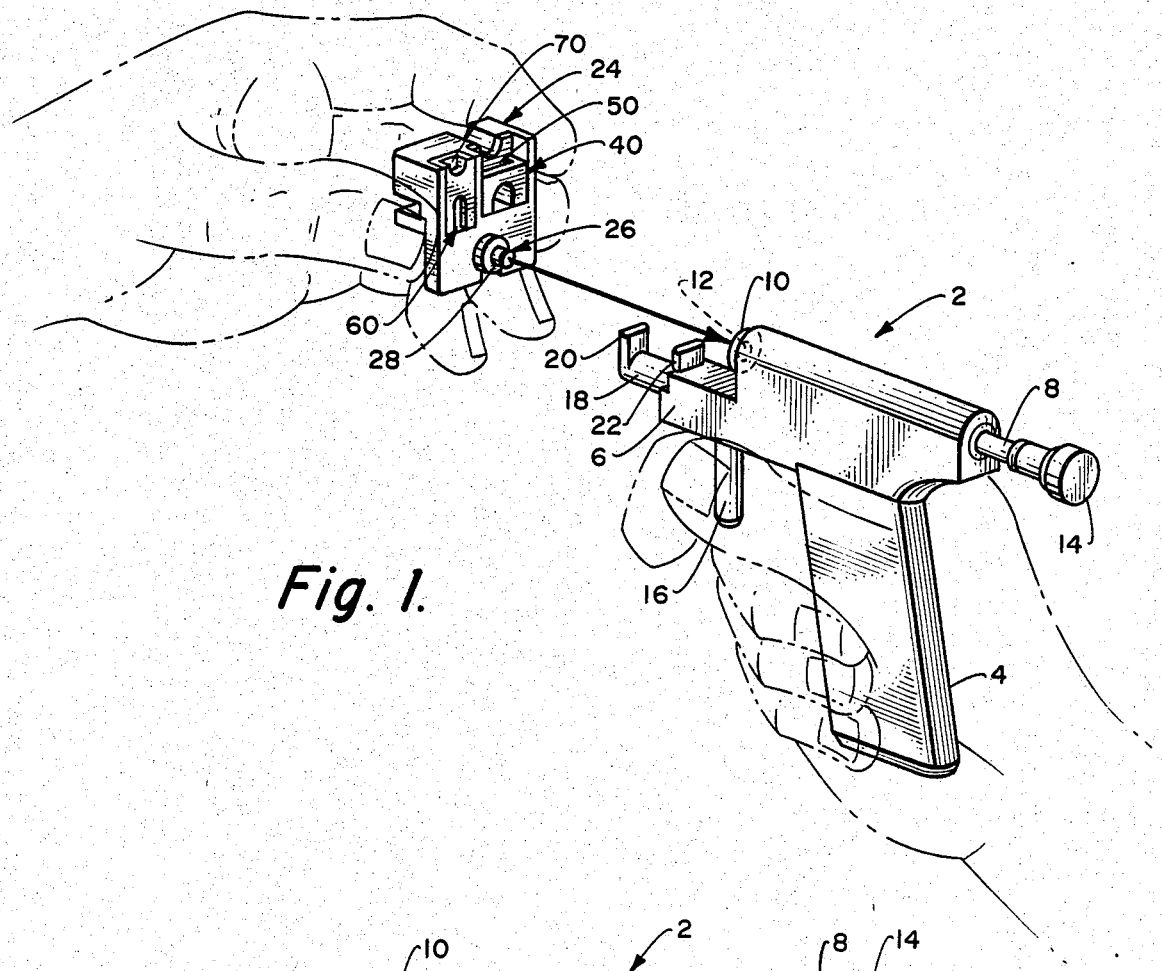
FIG. 1 is a perspective view illustrating the stud gun of this invention readied to receive the disposable components.
Figure 2:
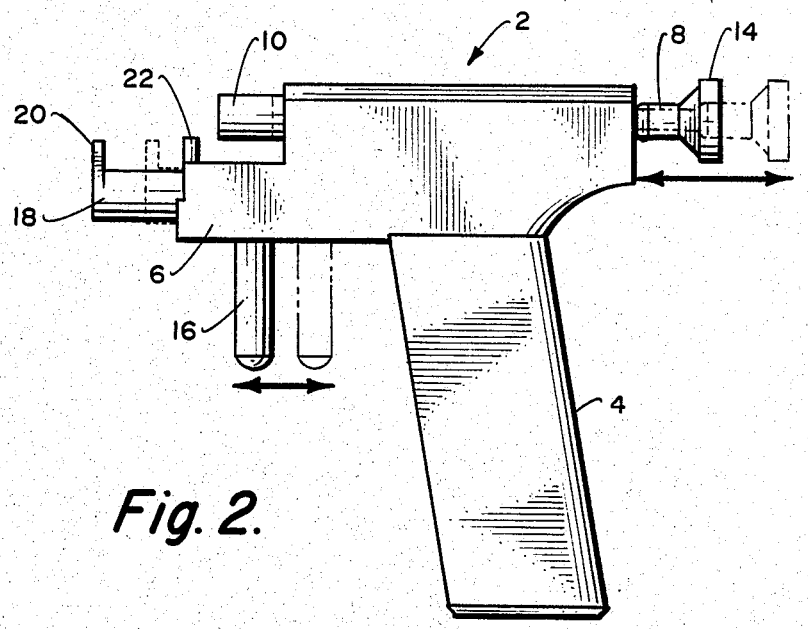
FIG. 2 is a side view of the stud gun of this invention not having the disposable components in place.
Figure 3:
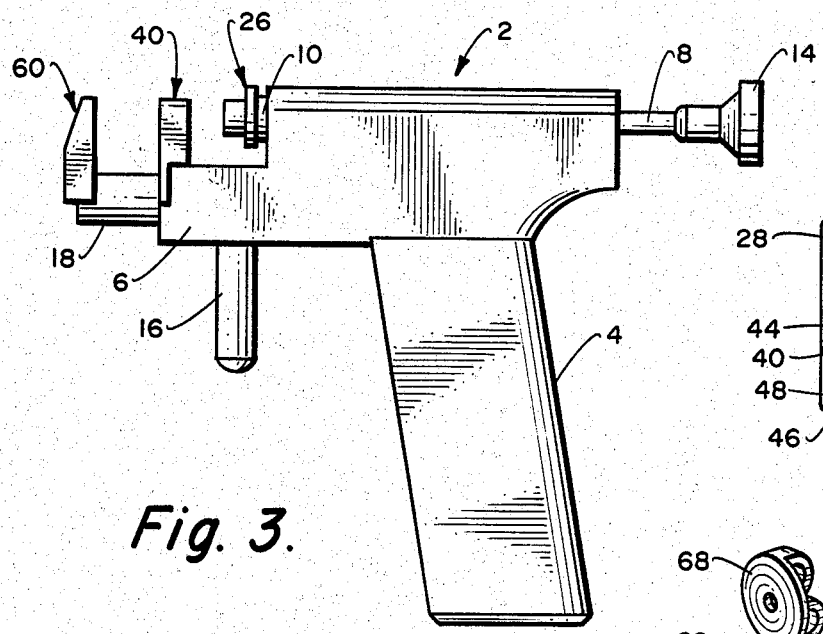
FIG. 3 is a view similar to FIG. 2 but showing the disposable components in place.

Referring to the drawings wherein like numerals of reference designate like elements throughout it will be noted that the stud gun 2 of the invention is pistol-like in configuration having a handle portion 4 and a barrel portion 6 carrying a plunger member 8 having an end 10 with recess 12 and having an enlarged head 14 and axially moveable from a first, uncocked position to a second, cocked position as shown in FIGS. 1, 2 and 3. The plunger 10 acts against a spring (not shown) and is operatively connected to a trigger mechanism 16 the release of which causes plunger 10 to be driven from the cocked to the uncocked position (right to left as shown in FIG. 2) as will become apparent as the description proceeds herein.

The trigger member 16 has an extending portion 18 which moves in an axial manner best seen in FIG. 2 of the drawings. That is, when the plunger member 8 is cocked, the trigger 16 and integral extension 18 moves to the dotted line position shown in FIG. 2 to uncock or release the plunger 8 which then moves to the whole line position as seen in FIG. 2 as will become apparent as the description proceeds herein. Intermediate the plunger 8 and extending portion 18 which has an extending upwardly protuberance 20 for purposes which will become apparent, is an intermediate upwardly projecting tab 22 rigidly secured to the barrel 6. No claim is made to the stud gun 2, per se, except insofar as the sterile components and the system of the invention is involved.

Figure 4:
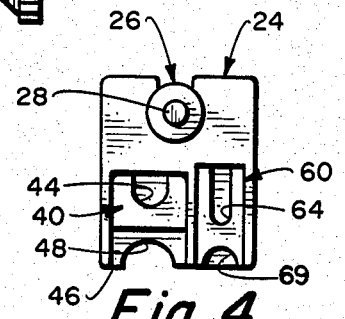
FIG. 4 is an end view of the carrier for the disposable components which carrier is illustrated in FIG. 1.
Figure 5:
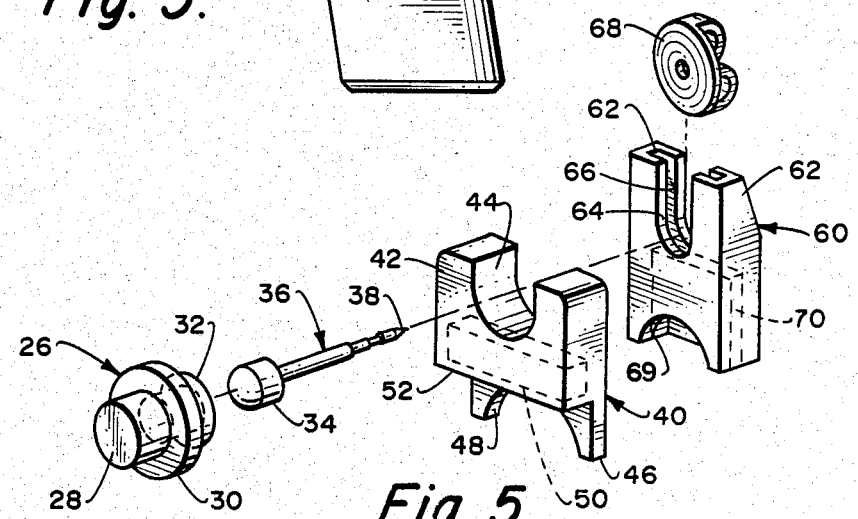
FIG. 5 is an enlarged view of the disposable components of the sterile stud implacement system of the invention.
Figure 6:
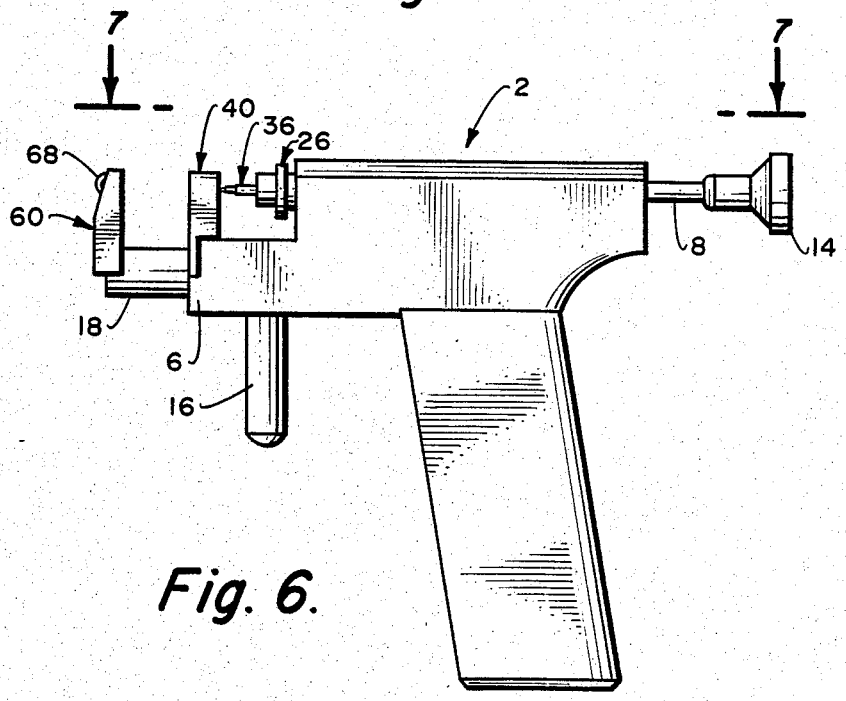
FIG. 6 is a side view of the stud gun of the invention having the stud and clasp readied for the ear piercing operation.
Figure 7:
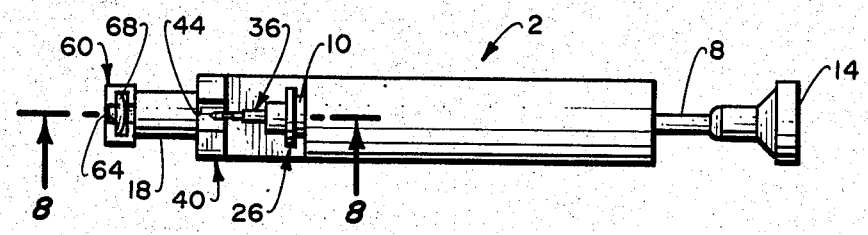
FIG. 7 is a view taken along the line 7—7 of FIG. 6.
Figure 8:
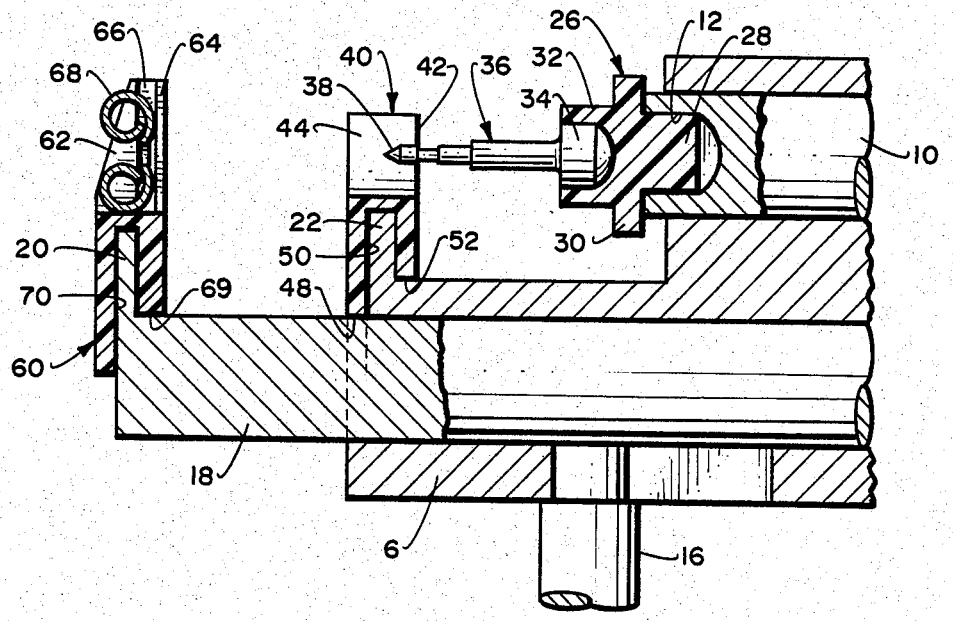
FIG. 8 is a fragmented, enlarged, side elevational view illustrating the disposable components of the stud gun of the invention.

The disposable components of the stud gun 2 will now be described by specific reference to FIGS. 3, 4 and 5 of the drawings. The first sterile component which is carried, for example, in a carrier 24 is the stud holder 26 having a first, cylindrical extending portion 28, an annular, enlarged flange 30 and an extending collar portion 32 of sufficient diameter and depth to receive the head 34 of stud 36 having sharpened point 38. The studs 36 are of conventional design and manufacture.

The next salient, sterile component of the inventive system is the alignment member 40 also carried in the carrier 24 in an manner which allows assemblage with stud gun 2 in a sterile manner as will become apparent. The alignment member 40 has an upper yoke portion 42 having a semicylindrical, cut-out portion 44 sufficient to allow clearance for the stud 36 to pass therethrough. The lower portion 46 has a similar semicylindrical cut-out 48 of a diameter equal to the diameter of extending portion 18 so that there is no interference with the axial movement of the trigger member 16 with integral, extending portion 18. A recess or slot 50 is provided in the underportion 52 of member 40 of a depth and size so as to receive the upwardly extending tab 22 to thereby maintain the alignment member 40 in secure, rigid fit relationship therewith.

The remaining disposable component of the sterile system of the invention is clasp carrying member 60 having an upwardly projecting body portion 62 separated by extenuated slot 64 and having between the upper portions 62 a receiving channel 66 to receive clasp or stud retainer 68 such that the stud 36 may be driven into retained relationship with the clasp 68 as will become apparent. The clasp retaining member 60 has a semicircular, cut-out 69 equivalent in diameter to the diameter of extending portion 18 and has a slot 70 of a size and depth to accommodate upstanding protuberance 20 in secured fiction fit and releasable manner.

The components 26, 40 and 60 are of moldable plastic, or the like, which is sterilizable in blister packages by any of the known sterilization techniques and is of sufficient rigidity to be able to withstand impacts involved in the piercing and implacement of stud and clasp in the sterile system of the invention.

The carrier 24 is of molded plastic and as best seen in FIG. 1 the disposable stud holder 26 is positioned such that upon being taken from the sterilized blister package (FIG. 9) it may be associated with the plunger 10 and more specifically the recess 12 thereof without being touched by human hands. To insert the components 40 and 60 the carrier 24 is merely rotated 180° and the recess 50 aligned with the upstanding tab 22 and press-fitted into fiction fit retention so that the component 40 may be removed from the carrier 24. A similar action is taken with respect to clasp carrier 60 being associated with the protuberance 20.

Figure 9:
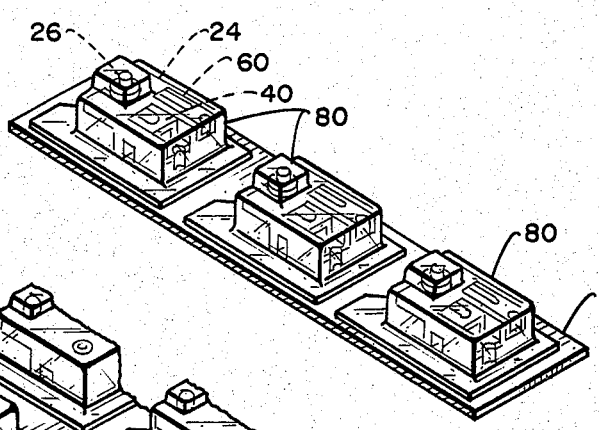
FIG. 9 is a fragmented view illustrating the blister packaging of the disposable components of the stud gun of the invention.
Figure 10:
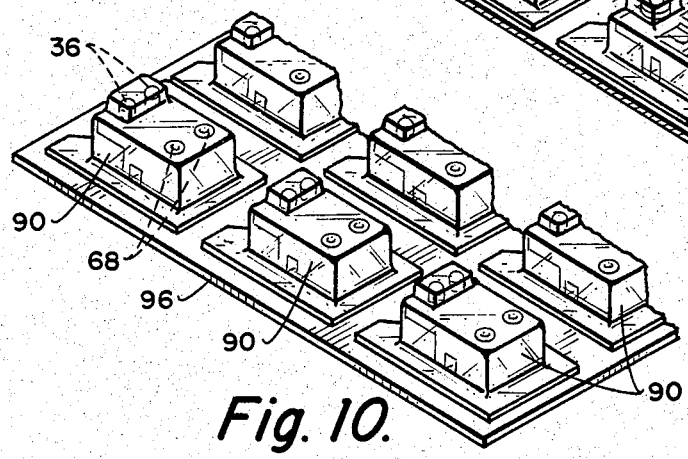
FIG. 10 is a fragmented view illustrating the blister packaging of the studs and clasps utilized with the sterile stud implacement system of the invention.

Referring to FIG. 9 it will be seen that the components 26, 40 and 60 are associated with the carrier 24 in blister pack form which has been subjected to a previous sterilizing process. Each individual blister pack 80 houses the carrier 24 with associated disposable components 26, 40 and 60. Each blister package 80 is disassociable from the bottom sheet 82 in a manner well known in the art and the blister packs 80 may comprise any number per sheet but twelve has been found to be the most ideal. Likewise, the individual blister packs 90 carrying the studs 36 and retainers 68 are packaged in blister sterlized form on carrier sheet 96, again preferably twelve to a sheet, such that upon an ear piercing operation to be performed, almost complete sterility can be maintained as will now be described.

Upon a customer wishing to have her ears pierced the stud gun 2 as shown in FIG. 2 is first readied to receive the disposable components of the invention. The blister pack 80 is opened to allow removal of one carrier 24 having the disposable components thereon. The first component to be positioned in the stud gun 2 is the stud holder 26 which is frictionally retained in the recess 12 of the plunger 10 in the manner depicted in FIG. 1. Next, the carrier 24 is rotated so as to position the abuttment member 40 over the upstanding tab 22 for association therewith. Finally, the clasp retainer 60 is positioned on the protuberance 20. The stud gun 2 is now in the form illustrated in FIG. 3 readied to receive the stud and clasp for the ear piercing and stud and clasp association procedure.

The stud 36 is removed from the sterlized blister pack and the head 34 thereof placed in the stud holder 26 by means of having the gun held in a slightly upwardly tilted position. The clasp 68 is put in the channel 66 and the gun 2 is now ready for the first ear piercing operation. The trigger 16 is pulled thereby bringing the extending portion 18 with the clasp retainer 60 thereon towards the plunger 10 to release the same and to drive the plunger 10 towards the clasp retainer member 60 whereby the plunger member 10 continues until just short of alignment member 40. At this time the stud 36 and more specifically the pointed end 38 is driven through the earlobe and the end 38 is driven into retained relationship with the clasp 68. No claim is made to the configuration of the stud and clasp since these are of conventional design and those of ordinary skill in the art are well aware of the manner in which the stud guns of the prior art, as well as the studs and clasps or backs, are used to pierce ears and affix studs or posts in the manner just described.

Upon fulfillment of the piercing operation the user of the system, and more specifically the stud gun 2, merely removes the components 26, 40 and 60 thereby readying the stud gun 2 for the next piercing operation and discarding the unsterile components which may or may not be contaminated from the prior user thereby obviating the necessity to sterilize the entire stud gun 2.

The stud gun 2 may utilize an elastomeric O-ring adjacent the enlarged head 14 so as to dampen the impact forces during the piercing and setting operation. To that end, and so as to ensure that the plunger 8 does not over shoot, the alignment member 40, which ordinarily acts as an ear lobe positioner, will provide an abutment stop to prevent trauma to the ear lobe.

While the description has been described with respect to specific details and materials of construction, those of ordinary skill in the art will at once recognize various changes and modifications which may be made to the herein disclosed invention and all of which will not depart from the essence of the invention and all such changes and modifications are intended to be covered by the appended claims.

I claim:

1. A sterile stud implacement system comprising the combination: a pistol-like member having a handle portion and a barrel portion, said barrel portion carrying a plunger for axial movement from a first, cocked position to a second, released position and being operatively connected to a trigger member, said trigger member having a clasp carrying portion and being positionable in a first, clasp carrying position and a second, clasp setting position, the triggering of said trigger member causing said plunger member and said clasp carrying portion to be forcibly driven towards each other to engage at an intermediate alignment member operably associated with said barrel portion the end surface of said plunger member having a recess receiving a separable and disposable stud driver wherein said stud driver has an integral construction having a solid, cylindrical portion adapted to be received in said plunger member and enlarged, annular flange and an extending, hollow, cylindrical portion adapted to loosely receive the head of a stud therein, said clasp carrying portion, intermediate alignment member and said stud driver being releasably and disposably retained in operative relationship for singular, sterile, stud and clasp implacement in an earlobe or the like.

2. The system in accordance with claim 1 wherein said intermediate alignment member is H-shaped and has a recess for fiction fit relationship with said barrel portion and has an upwardly extending tab to be received in said recessed portion.

3. The system in accordance with claim 2 wherein said intermediate alignment member has a semi-cylindrical cut-out upper portion adapted to act as an abutment stop for said annular flange of said stud driver.

4. The system in accordance with claim 3 wherein said trigger member has a terminus with an upwardly extending protuberance and said clasp carrying portion is fictionally retained in association with said protuberance.

5. The system in accordance with claim 4 wherein said clasp carrying portion has a recess of a size and configuration to be received by said upstanding protuberance and wherein an upwardly extended portion defines an elongate retaining slot of a size and configuration to carry a clasp therein.

6. The system in accordance with claim 5 wherein said releasable and disposable components are fabricated of moldable, sterilizable plastic.

7. The system in accordance with claim 6 wherein said disposable components are carried in a carrier which is configured in a manner that does not require touching said components with the human hand for association with said pistol-like member.

* * * * *